US006732385B1

(12) United States Patent
Henderson et al.

(10) Patent No.: US 6,732,385 B1
(45) Date of Patent: May 11, 2004

(54) WALL MOUNTABLE DRAIN STOPPER

(75) Inventors: Scott Henderson, Brooklyn, NY (US); Wilfrido Loor, Brooklyn, NY (US)

(73) Assignee: WKI Holding Company, Inc., Reston, VA (US)

( * ) Notice: Subject to any disclaimer, the term of this patent is extended or adjusted under 35 U.S.C. 154(b) by 0 days.

(21) Appl. No.: 10/339,966

(22) Filed: Jan. 10, 2003

(51) Int. Cl.[7] ..... A47K 1/14
(52) U.S. Cl. ..... 4/295
(58) Field of Search ..... 4/295, 293, 292, 4/290, 287, 286; 248/683, 363, 309.3

(56) References Cited

U.S. PATENT DOCUMENTS 656,352 A * 8/1900 Holmes ..... 4/293
1,370,170 A * 3/1921 Ullman ..... 4/295
1,384,038 A * 7/1921 Becker ..... 4/295
2,385,977 A 10/1945 Farmer
2,721,467 A * 10/1955 Modrey ..... 68/184
2,858,989 A * 11/1958 Jordan ..... 241/46.015
3,514,065 A * 5/1970 Litt et al. ..... 248/363
D357,170 S 4/1995 Wellsfry
5,404,596 A * 4/1995 Coory ..... 4/287
5,772,268 A 6/1998 Chabrier

* cited by examiner

*Primary Examiner*—Gregory L. Huson
*Assistant Examiner*—Huyen Le
(74) *Attorney, Agent, or Firm*—Seyfarth Shaw LLP

(57) ABSTRACT

A drain stopper includes a suction cup. The drain stopper is configured to block a drain opening and prevent water from entering the drain. The suction cup allows the drain stopper to be stored on a variety of surfaces, such as a vertical bathtub wall. In one form, the suction cup is on the bottom of the drain stopper and fits within the drain opening.

14 Claims, 2 Drawing Sheets

WALL MOUNTABLE DRAIN STOPPER

BACKGROUND

The following disclosure relates to drain stoppers and methods for using and storing drain stoppers, and has particular application to drain stoppers and methods for using and storing drain stoppers where the drain stopper can be removably mounted to a surface, such as a wall or shower door.

Drain stoppers are constructed to plug, or otherwise block, a drain opening to prevent or minimize the flow of water down the drain. Normally, drain stoppers are easily removable to allow water to flow out of a container, such as a sink or bathtub, and into the drain when blocking the drain is no longer desired. Numerous types of drain stoppers are available, such as a drain plug, that is sized to fit into and plug the drain opening in a fashion similar to a cork plugging the opening of a bottle. Other forms of drain stoppers do not fit within the drain opening, but instead fit over the top of the drain opening and extend beyond the drain opening. Typically, such drain plugs and other drain stoppers are made from hard rubber, or other hard rubber-like materials. Other forms of drain stoppers are made from a soft rubber or soft rubber-like material, such as soft PVC or equivalent material. In some instances, such drain stoppers can be a soft rubber-like material that fits over the drain, with the water pressure causing the stopper to seal against the surrounding bottom of the container so that little, if any, water flows into the drain.

However, drain stoppers similar to the above types can be somewhat annoying to use because there is often not a good place to store these drain stoppers when they are not being used to block a drain. In some cases, the drain stopper includes a metallic ring in the top that is connected to a portion of a sink or bath tub by a chain that is similar to pull chains used on light sockets. Often such drain stoppers are stored by wrapping the chain over the tub faucet or another nearby fixture. Other times, drain stoppers are placed on a ledge of the tub or sink where it is used. Some people even place the drain stopper in a drawer or in a sink cabinet when it is not in use.

SUMMARY

The disclosed apparatus and methods avoids some of the disadvantages of prior apparatus and methods while affording additional structural and operating advantages.

The disclosed apparatus and methods comprise certain novel features and a combination of parts hereinafter fully described and illustrated in the accompanying drawings, it being understood that the various changes in the details may be made without departing from the spirit, or sacrificing any of the advantages of the present disclosed apparatus and methods.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
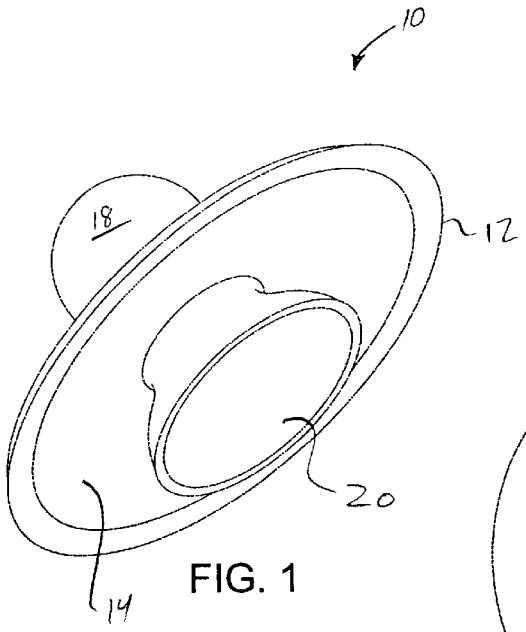
FIG. 1 is a perspective view of a drain stopper in accordance with the present invention.
Figure 2:
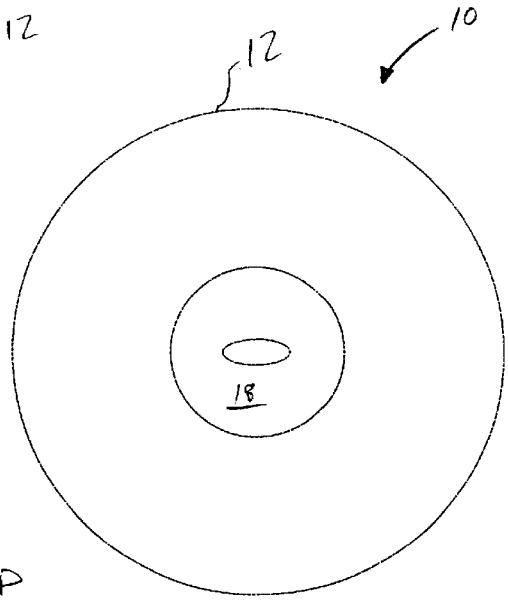
FIG. 2 is a top plan view of the drain stopper of FIG. 1.
Figure 3:
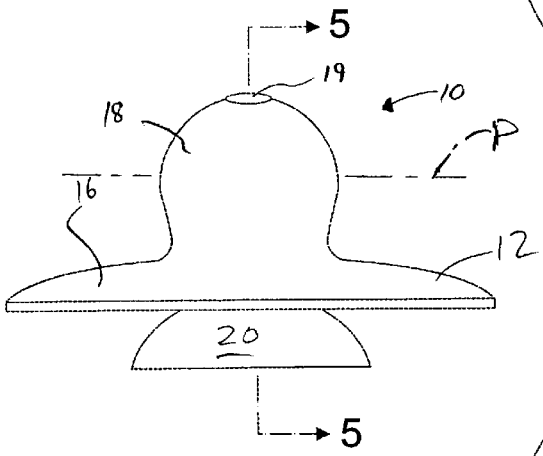
FIG. 3 is a side view of the drain stopper of FIG. 1.
Figure 4:
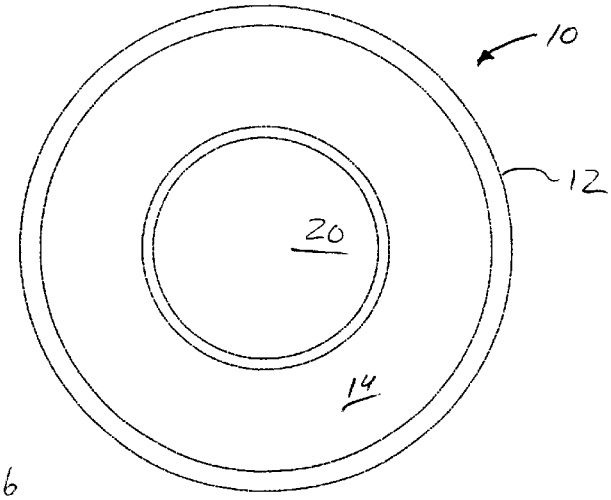
FIG. 4 is a bottom plan view of the drain stopper of FIG. 1.
Figure 5:
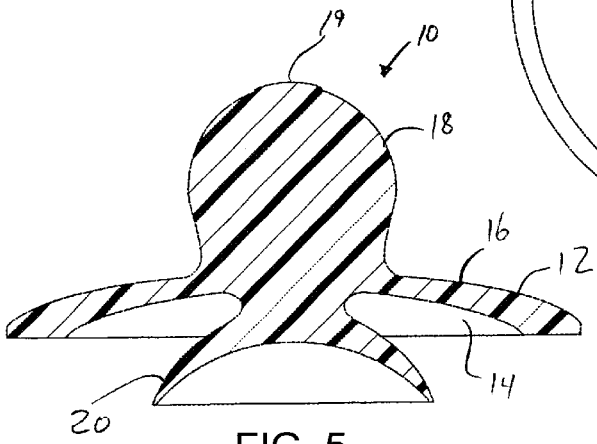
FIG. 5 is a sectional view taken along the line 5—5 of FIG. 3.

Referring to FIGS. 1–5, a drain stopper 10 can be molded from a flexible and resilient material, such as thermoplastic rubber, soft PVC, an elastomer of the type sold under the trade name Santoprene, or silicone. In one form, drain stopper 10 can be one unitary piece molded from a translucent material.

Drain stopper 10 includes a body that can be in the form of a disk-like member referred to hereinafter as "disk" 12 having a bottom 14 and a top 16. In one form, disk bottom 14 has a substantially concave surface. Alternatively, disk bottom 14 can have a substantially flat surface. In contrast, disk top 16 can have a substantially convex surface. However, in an alternative form, disk top 16 could be a substantially flat surface. In one form, disk 12 is larger than the opening of a drain with which it is to be used and blocks the drain when disk 12 is placed over the drain, thereby preventing water from entering the drain or minimizing the amount that enters the drain. In an alternate form, disk 12 is slightly smaller, or approximately the same size, as the size of the drain opening such that disk 12 can be inserted into the opening to block the drain.

A grip 18 can be formed on the disk top 16 to allow drain stopper 10 to be easily gripped. In one form, grip 18 has a maximum cross-sectional area (in a plane "P" perpendicular to line 5—5 of FIG. 3) that is approximately circular and has a circular profile when viewed from above (see FIG. 2). In one form, the cross-sectional area of grip 18 increases from disk top 16 toward plane "P". Additionally, the cross-sectional area of grip 18 can increase from the grip top 19 toward plane "P."

A suction cup 20 can be included with drain stopper 10 and can be located on disk bottom 14. However, it is also possible that suction cup 20 could be located on the disk top 14 and may even form grip 18. Suction cup 20 has a concave interior surface and is used to removably mount drain stopper 10 to a surface near a drain, such as a shower stall wall. Suction cup 20 can be an integral part of disk 12 or can be attached to disk 12 in any appropriate manner. If suction cup 20 is located on the disk bottom 14, suction cup 20 can be made smaller than the drain opening that it would be used with to allow suction cup 20 to fit within the drain opening so that it does not interfere with disk 12 blocking the drain. In such case, suction cup 20 would normally be sized to be smaller than a standard size drain opening of the type with which the stopper 10 is intended to be used, such as a 4" kitchen sink drain or a 1⅝" drain.

Figure 6:
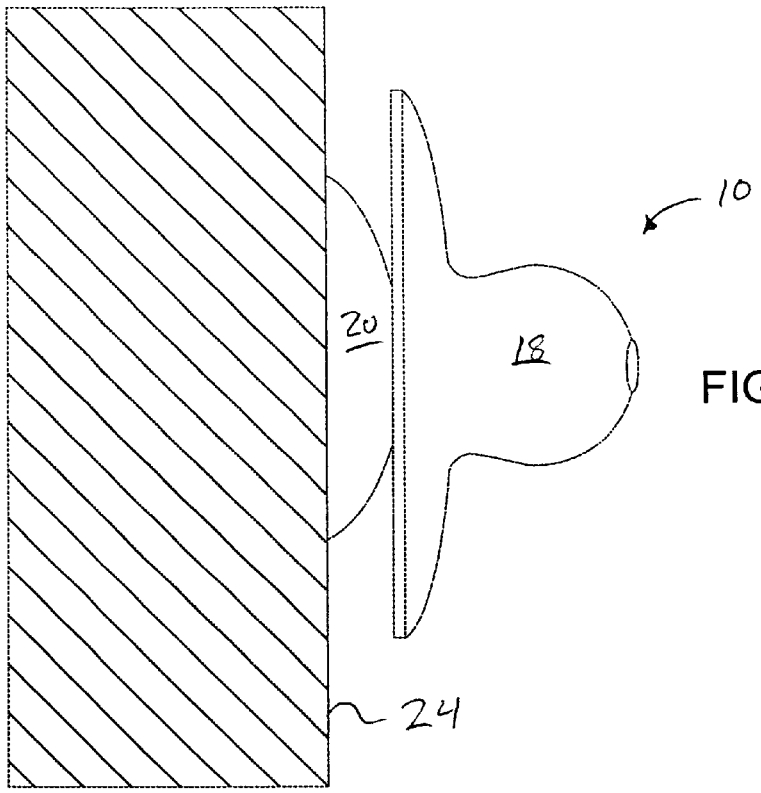
FIG. 6 is a view similar to FIG. 3, with the drain stopper rotated 90° and removably mounted to a wall.
Figure 7:
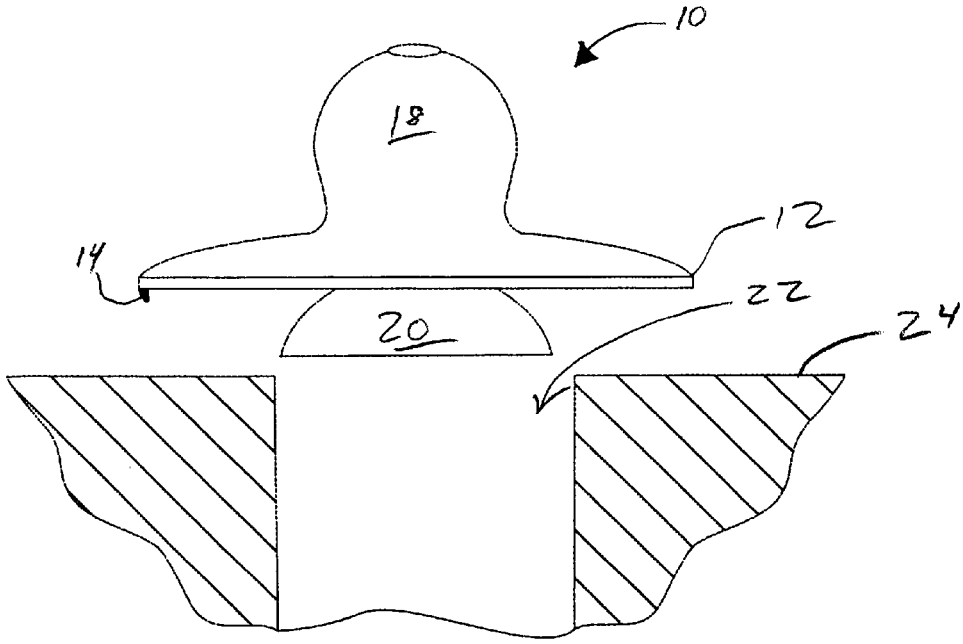
FIG. 7 is a view similar to FIG. 3 and including a partial sectional view of a drain opening in a container.

Referring to FIGS. 6 and 7, in use, the user holds grip 18 and inserts suction cup 20 into drain opening 22. The body of drain stopper 10 blocks drain 22 so that water is prevented from entering, or minimizing the amount that enters the drain, thereby blocking drain 22. In one form, disk bottom 14 contacts the portion of the surface of the container 24 (such as a bathtub, shower, or sink) that surrounds drain 22, thereby blocking drain 22. As water is added, the pressure of the water on the top of drain stopper 10 increases the force between disk bottom 14 and container 24, thereby creating a better seal that blocks drain 22.

In order to drain container 24, the user holds grip 18 and removes drain stopper 10 from the area in close proximity to drain 22, thereby unblocking drain 22. When not in use, drain stopper 10 can be stored by using grip 18 to removably mount suction cup 20 to any appropriate surface, such as vertical surface 24, which can be a portion of a sink, bathtub, shower, a nearby wall or a nearby door.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A drain stopper comprising:

a grip;

a body coupled to the grip, the body having a central axis and terminating at a distal end and configured to block a drain opening and prevent water from entering the drain opening; and a suction cup coupled to the body centrally thereof and having a wall which slopes laterally outwardly and away from the grip and extends axially beyond the distal end of the body.

2. The drain stopper of claim 1, wherein the body is substantially in the form of a disk formed from a flexible and resilient material, the disk being larger than the drain opening and configured to cover the drain opening.

3. The drain stopper of claim 2, wherein the disk comprises a top and a bottom, and the suction cup is attached to the disk bottom.

4. The drain stopper of claim 3, wherein the grip projects from the disk top and has a substantially circular cross-section.

5. The drain stopper of claim 4, wherein the grip has a top and a bottom, the grip bottom being coupled to the disk top, and wherein the cross-sectional area of the grip increases from the grip bottom to a first plane nearer the grip top.

6. The drain stopper of claim 5, wherein the cross-sectional area of the grip increases from the grip top to a second plane nearer the grip bottom.

7. The drain stopper of claim 6, wherein the first plane and the second plane are the same plane.

8. The drain stopper of claim 7, wherein the drain stopper is made of a translucent material.

9. The drain stopper of claim 8, wherein the disk and the suction cup are made of the same material.

10. The drain stopper of claim 9, wherein the disk and the suction cup are a unitary piece.

11. The drain stopper of claim 4, wherein the cross-sectional area of the grip increases from the grip top to a second plane nearer the grip bottom.

12. A method of using a drain stopper, comprising:

providing a drain stopper having a body with a central axis and a suction cup coupled to the body and having a portion extending axially beyond the body;

blocking a drain with the body of the drain stopper;

removing the drain stopper from the proximity of the drain; and storing the drain stopper, when it is not blocking the drain, by removably attaching to a surface by suction the portion of the suction cup extending beyond the body.

13. The method of claim 12, wherein storing the drain stopper comprises removably mounting the drain stopper to a vertical surface.

14. The method of claim 12, wherein blocking the drain with the body of the drain stopper comprises covering a portion of a surface, that surrounds the drain, with the body.

* * * * *